US006415519B1

(12) United States Patent
Bennett

(10) Patent No.: US 6,415,519 B1
(45) Date of Patent: Jul. 9, 2002

(54) LINE HOLDER FOR CHALKING TOOL ESPECIALLY FOR MARKING DIAGONALS

(76) Inventor: Joe Bennett, 2880 Athens Hwy., Madison, GA (US) 30650

( * ) Notice: Subject to any disclaimer, the term of this patent is extended or adjusted under 35 U.S.C. 154(b) by 0 days.

(21) Appl. No.: 09/511,515

(22) Filed: Feb. 23, 2000

(51) Int. Cl.[7] ..... B44D 3/38
(52) U.S. Cl. ..... 33/414; 33/770
(58) Field of Search ..... 33/413, 414, 408, 33/410, 756, 758, 770

(56) References Cited

U.S. PATENT DOCUMENTS

| | | | | | |
|---|---|---|---|---|---|
| 1,798,476 | A | * | 3/1931 | Langsner | 33/758 |
| 2,629,935 | A | * | 3/1953 | Roe | 33/770 |
| 2,663,938 | A | | 12/1953 | Stodgell | |
| 2,676,374 | A | * | 4/1954 | Ballard | 33/770 |
| 2,770,883 | A | * | 11/1956 | Hackney | 33/770 |
| 2,865,107 | A | | 12/1958 | Castano | |
| 3,729,828 | A | * | 5/1973 | McKenzie | 33/408 |
| 4,561,189 | A | | 12/1985 | Hirneise | 33/408 |
| 4,819,337 | A | | 4/1989 | Noyes | 33/414 |
| 4,995,152 | A | | 2/1991 | Steckler | 24/129 R |
| 5,720,113 | A | | 2/1998 | Bartimus | 33/413 |
| 5,822,874 | A | | 10/1998 | Nemes | 33/414 |
| 5,937,532 | A | * | 8/1999 | Eirich et al. | 33/413 |
| 6,101,734 | A | * | 8/2000 | Ten Caat et al. | 33/770 |
| 6,108,926 | A | * | 8/2000 | Fraser et al. | 33/758 |
| 6,115,931 | A | * | 9/2000 | Arcand | 33/770 |

* cited by examiner

*Primary Examiner*—G. Bradley Bennett
(74) *Attorney, Agent, or Firm*—Baker, Donelson, Bearman & Caldwell

(57) ABSTRACT

A line holder for securing a chalking line to a work piece that is to be marked, particularly for diagonal cut lines, in which a planar body engages an end of a chalking line and includes a spaced-apart second opening, through which a spring-biased member extends. The member is joined to the planar body at a fixed end and has a pointed tip at a distal free end. The member is biased to a first position with the tip upwardly of the planar body and is selectively moveable to a second position with the tip extended through the second opening for engaging a work piece to be marked by the chalk line.

8 Claims, 1 Drawing Sheet

LINE HOLDER FOR CHALKING TOOL ESPECIALLY FOR MARKING DIAGONALS

TECHNICAL FIELD

The present invention relates to chalking tools for marking lines on wood boards for cutting. More particularly, the present invention relates to holders for securing chalking lines to the wooden work pieces to be marked using chalking tools for cutting on the marked lines.

BACKGROUND OF THE INVENTION

Construction of homes and buildings typically involve the use of large sheets of plywood and other elongate wooden boards. These wood boards are cut to size and shape for assembling frames, walls, sidings, and other portions of the buildings under construction. In some circumstances of such construction, cutting tolerances are not critical. For such instances, long boards and sheets of plywood are commonly cut with hand-held, high speed rotary saws. In some instances, the cuts can be accomplished by line-of-sight. In other instances, however, cut lines are first marked on the surface of the wood members for tracking by the craftsman using the power saw.

The lines are typically marked on the wood members with chalk lines. There are a variety of known chalk line holders that are readily available. These devices have reservoirs for powdered chalk, in which an extendable length of line is stored. For use, the chalk line is pulled from the reservoir coated with the powdered chalk. The chalk line is held at the beginning and ending of the cut, usually an edge portion of the board. The chalk line is pulled taut, and then snapped against the surface of the board to mark the line for cutting.

While this work typically requires two persons on opposing sides of the board to hold the chalk line in place for snapping the line, devices have been developed whereby an individual working alone can snap a chalk line. These devices have pins or other engaging mechanisms to secure the end of the chalk line to the board. While such devices are suited for snapping chalk lines, there are drawbacks to their use. In some instances, the pin is pulled out of the board when the line is pulled taut. This prevents snapping the line to mark the cut. The pin must be replaced or a second person may have to hold the other end, thereby defeating the purpose of the pin. Also, with the pin suddenly released, the holder may fly about and cause injury or damage. In some other of these devices, depending flanges engage the side edge of the board. However, these devices are impractical for marking diagonal lines, as the flange tends to slip along the side when making the diagonal mark.

Accordingly, there is a need in the art for an improved line holder for chalking tools. It is to such that the present invention is directed.

BRIEF SUMMARY OF THE PRESENT INVENTION

The present invention meets the need in the art by providing a line holder for securing a chalking line to a work piece that is to be marked particularly for diagonal lines. The line holder includes a planar body that defines a first opening in a portion of the body near a first distal end for engaging a portion of the chalking line, whereby the chalking line is secured to the planar body. The planar body also defines a second opening spaced-apart from the first opening. A spring-biased member attaches at a fixed end to the planar body and defines a pointed tip at a distal free end. The member is aligned with the second opening, and is biased to a first position with the tip substantially aligned with the planar body. The member is selectively movable to a second position with the tip extended through the second opening for engaging a work piece to be marked by the chalk line. In use, the line holder is positioned on the work piece to be marked. The spring-biased member is pushed from the first position to the second position with the tip exposed on the opposing side of the planar body. The line holder is moved laterally to bring the tip into engagement with the edge of the work piece to be marked. The line can then be extended to the opposing side of the work piece, stretched taut, and snapped, to mark the cut line on the wood piece.

Objects, advantages, and features of the present invention will become apparent from reading the following detailed description of the invention and the claims in view of the appended drawings.

DETAILED DESCRIPTION OF THE PREFERRED EMBODIMENTS

Figure 1:
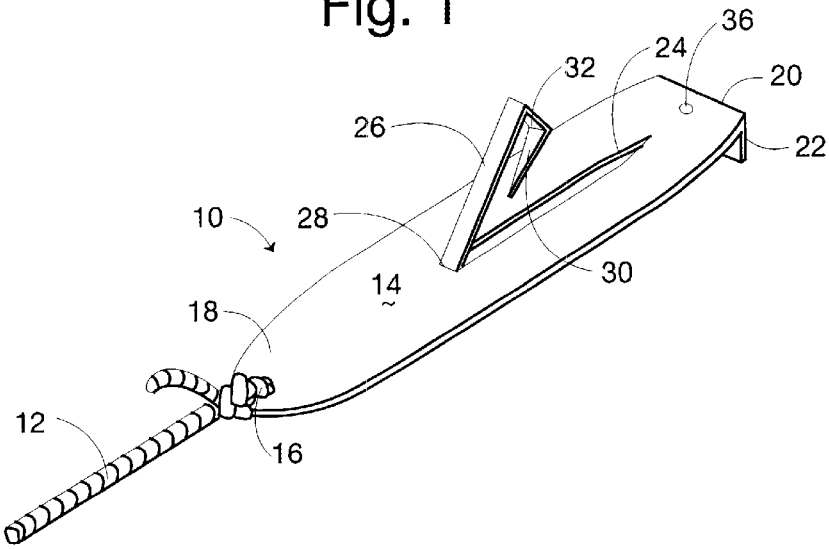
FIG. 1 illustrates a perspective view of the line holder according to the present invention.

Referring now in more detail to the drawings in which like parts have like identifiers, FIG. 1 illustrates in perspective view a line holder 10 for securing a chalking line 12 to a work piece to be marked for cutting, particularly for marking diagonal lines to be cut. The line 12 is conventionally received on a spool within a chalk reservoir of a conventional chalk line device, and no further discussion is believed required about such device. The line holder 10 includes a planar body 14 that defines an opening 16 at a first end 18. An opposing second end 20 defines a flange 22 extending in a first direction from the planar body 14. In the illustrated embodiment, the flange 22 extends at a substantially perpendicular angle from a bottom side of the planar body 14. The planar body 14 defines a second opening 24 intermediate the ends 18 and 20. The second opening 24 is preferably an elongate slot substantially longer in a longitudinal axis than in a transverse axis.

A spring-biased member 26 attaches at a first end 28 to the planar body 14. A distal end 30 defines a pointed tip. The point of the tip faces in a direction towards the first opening 16. This is accomplished by bending a distal end portion of the member 26 at substantially right angles first downwardly and then laterally. The distal end 30 is preferably thin in thickness and narrow in longitudinal axis, with a sharp pointed tip, for facilitating insertion of the tip into the side of a wood member to be marked, as discussed below.

In the illustrated embodiment, the member 26 is integrally attached at the end 28 to the planar body 14. The member 26 is cut from the planar body and this defines the outline of the opening 24. In this embodiment, the planar body 14 is preferably a spring steel. In an alternate embodiment, the member 26 is a separate member attached at the end 28 to the planar body 14, such as with rivets or other secure fastener. In this embodiment, the member 26 is spring steel.

The member 26 is preferably biased to a first position with the pointed tip 30 disposed upwardly of an upper surface of the planar body 14. The member 26 shields the tip 30 from inadvertent contact. The member 26 is selectively moveable to a second position with the member extended through the second opening 24 below the planar body 14. In the second position, the tip 30 is below the planar body 14 and pointed in a direction towards the first end 18.

The planar body 14 in the illustrated embodiment further defines a third opening or hole 36 in a distal end portion. The hole 36 receives a pin to secure the line holder 10 for scribing an arc on a wooden member.

Figure 3:
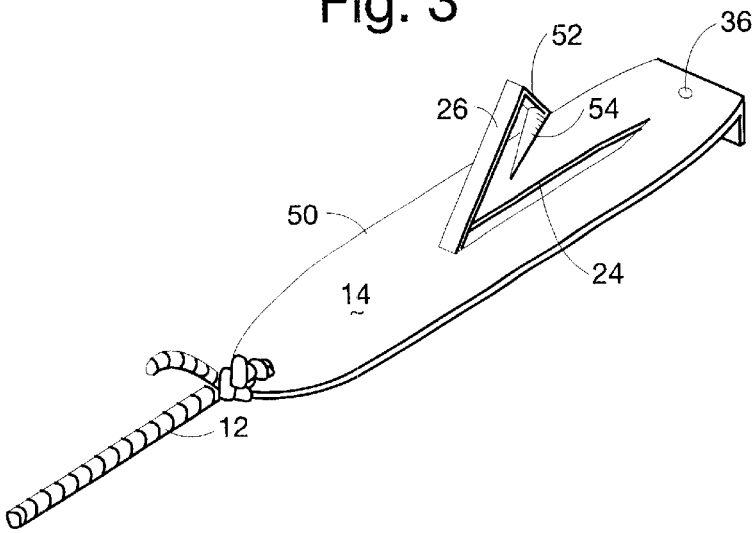
FIG. 3 illustrated an alternate embodiment of the line holder of the present invention.

FIG. 3 illustrates an alternate embodiment 50 of the line holder. In this embodiment, the member 26 defines a distal portion 52 that is bent at a downward angle. A conical tip 54 is attached rigidly to the distal portion 52. The tip 54 is directed along a line towards the first end 18. The conical tip 54 is preferably narrow and elongated to facilitate insertion of the tip into the wood member to be marked. FIG. 3 also illustrates an embodiment of the line holder which does not include the flange 22.

Figure 2:
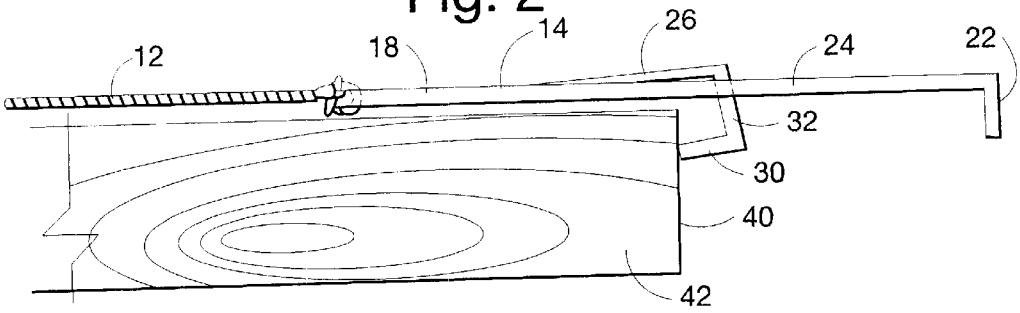
FIG. 2 illustrates a side view of the line holder illustrated in FIG. 1 operatively engaged with a work piece to be marked by a chalk line, in accordance with the present invention.

The operation of the line holder 10 is described with reference to FIG. 2. The line holder 10 is positioned at an edge 40 of a wood member 42 to be marked by the chalk line 12. A lateral portion of the line holder IO extends outwardly of the wood member 42. The member 26 is moved from the first position to the depending second position. This positions the pointed tip 30 below the planar body 14. The pointed tip 30 faces in a direction generally towards the opening 16. The line holder 10 is moved laterally towards the wood member 42. This drives the pointed end 30 into the side 40 of the wood member 42 thereby securing the line holder to the wood member 42 to be marked. The line 12 is pulled outwardly of the chalk line device. A portion of the powdered chalk covers the line. The line 12 is pulled to an opposing point along the line to be marked on the wood member 42. The line to be marked can be at a sharp angle relative to the side 40, especially for marking a diagonal line without slippage of the line 12 or the line holder 10. The line 12 is pulled taut and snapped against the wood member 42 to mark the line. This is accomplished by grasping the line 12 and pulling upwardly before releasing in order to forcibly direct the line against the upper surface of the wood member 42. The flange 22 provides a grip for holding the line holder 10.

In an embodiment including the hole 36, the line holder 10 also may scribe an arc on the wood member 42. This is accomplished by inserting a pin through the hole 36, and extending the line 12 across the surface of the wood member. A marker, such as a pencil or ink pen, is held at a predetermined place on the line 12. The arc is scribed by moving the marker laterally, with the line holder 10 rotating about the pin in the hole 36.

In a preferred embodiment, the line holder 10 is manufactured from a spring metal. However in an alternate embodiment the member can be molded with resilient plastic.

It is thus seen that an improved line holder is provided for securing a chalking line to a work piece to be marked especially for marking diagonal cut lines. While this invention has been described in detail with particular reference to the preferred embodiments thereof, the principals and modes of operation of the present invention have been described in the foregoing specification. The invention is not to be construed as limited to the particular forms disclosed because these are regarded as illustrative rather than restrictive. Moreover, modifications, variations, and changes may be made by those skilled in the art without departure from the spirit and scope of the invention as described by the following claims.

What is claimed is:

1. A line holder for securing a chalking line to a work piece that is to be marked for cutting, comprising:

a planar body defining a first opening in a portion thereof near a first distal end for receiving a portion of a chalking line therethrough, whereby the chalking line is secured to the planar body, and defining a second opening spaced-apart therefrom;

a spring-biased member joined to the planar body at a fixed end and having two substantially perpendicular bends defined in distal portions of the member to orient a pointed tip at a distal free end towards the first opening, said member aligned with the second opening, the member biased to a first position with the tip aligned with the planar body and the member selectively moveable to a second position with the tip extended through the second opening for engaging a side edge of a work piece to be marked by the chalk line upon lateral movement of the line holder in a direction towards the first opening.

2. The line holder as recited in claim 1, wherein the spring-biased member is integrally joined at the fixed end with the planar body.

3. The line holder as recited in claim 1, wherein the second opening is defined in the planar body by a pair of opposing sides and a distal end with an intermediate portion of the planar body freed on three sides, to thereby define the spring-biased member attached at the fixed end to the planar body.

4. The line holder as recited in claim 1, wherein the planar body defines a third opening in a second distal end opposing the first opening, for receiving a pin therethrough, whereby the line holder, being held by the pin in the work piece, is rotatable to scribe an arc in the work piece.

5. The line holder as recited in claim 1, wherein the planar body defines a hook portion at the second distal end, for overlapping a side edge of the work piece.

6. The line holder as recited in claim 1, wherein the pointed tip is defined by a conical-shaped member attached to the distal end of the spring member.

7. A line holder for securing a chalking line to a work piece that is to be marked for cutting, comprising:

a planar body defining a first opening in a portion thereof near a first distal end for receiving a portion of a chalking line therethrough, whereby the chalking line is secured with a knot to the planar body, and defining a second opening spaced-apart therefrom;

a spring-biased member integral with the planar body at a fixed end and having a pointed tip at a distal free end aligned with the second opening, the distal end defined by a first portion of the spring member extendable through the second opening and a second portion that extends laterally towards the first hole, the member biased to a first position with the tip upwardly from the planar body and the member selectively moveable to a second position with the tip extended through the second opening for engaging a work piece to be marked by the chalk line.

8. The line holder as recited in claim 7, wherein the planar body defines a third opening in a second distal end opposing the first opening, for receiving a pin therethrough, whereby the line holder, being held by the pin in the work piece, is rotatable to scribe an arc in the work piece.

* * * * *